US010051697B2

(12) United States Patent
Gong et al.

(10) Patent No.: US 10,051,697 B2
(45) Date of Patent: Aug. 14, 2018

(54) FREE VOLTAGE LED DRIVING DEVICE WITH HIGH LUMINOUS UNIFORMITY RATIO

(71) Applicants: Myeong-Kook Gong, Yongin-si (KR); Da-Young Gong, Yongin-si (KR)

(72) Inventors: Myeong-Kook Gong, Yongin-si (KR); Da-Young Gong, Yongin-si (KR)

( * ) Notice: Subject to any disclaimer, the term of this patent is extended or adjusted under 35 U.S.C. 154(b) by 0 days.

(21) Appl. No.: 15/720,382

(22) Filed: Sep. 29, 2017

(65) Prior Publication Data

US 2018/0116017 A1 Apr. 26, 2018

(30) Foreign Application Priority Data

Oct. 24, 2016 (KR) ..... 10-2016-0138068
Aug. 11, 2017 (KR) ..... 10-2017-0102592

(51) Int. Cl.
*H05B 33/08* (2006.01)

(52) U.S. Cl.
CPC ..... *H05B 33/0815* (2013.01); *H05B 33/083* (2013.01); *H05B 33/089* (2013.01); *H05B 33/0845* (2013.01)

(58) Field of Classification Search
None
See application file for complete search history.

(56) References Cited

U.S. PATENT DOCUMENTS 9,913,337 B2 * 3/2018 Kim ..... H05B 33/0824
2012/0098448 A1 * 4/2012 Kang ..... H05B 33/0809 315/201
2013/0169160 A1 * 7/2013 Kim ..... H05B 37/02 315/122
2015/0382420 A1 * 12/2015 Sakai ..... H05B 33/0803 315/193
2016/0007420 A1 * 1/2016 Gong ..... H05B 33/0815 315/187
2018/0027617 A1 * 1/2018 Gong ..... H05B 33/0815 315/187

FOREIGN PATENT DOCUMENTS

| | | |
|---|---|---|
| JP | 8-106988 | 4/1996 |
| KR | 10-1217063 | 12/2012 |
| KR | 10-2013-0104580 | 9/2013 |
| KR | 10-2014-0057925 | 5/2014 |
| KR | 10-2015-0134293 | 12/2015 |

* cited by examiner

*Primary Examiner* — Jany Richardson
(74) *Attorney, Agent, or Firm* — Lewis Roca Rothgerber Christie LLP

(57) ABSTRACT

A free voltage LED driving device with a high luminous uniformity ratio includes a rectifying device for rectifying an AC voltage applied thereto from outside and outputting a DC voltage; a plurality of LED array parts to have the DC voltage applied thereto to emit light emitting diodes; a plurality of current drain switching devices to have current that is output from each of the plurality of LED array parts applied thereto, outputting a plurality of currents having a drain current value; a series type switching device controlling a transfer of current according to an opening and closing of a plurality of built-in transistors; a current control variable resistance part for varying and adjusting a resistance value so that power is output in a constant manner when the applied AC voltage changes; and a voltage detecting circuit part to detect the DC voltage.

17 Claims, 8 Drawing Sheets

FREE VOLTAGE LED DRIVING DEVICE WITH HIGH LUMINOUS UNIFORMITY RATIO

CROSS-REFERENCE TO RELATED APPLICATION

This application claims priority to Korean Patent Application No. 10-2016-0138068 filed on Oct. 24, 2016 and Korean Patent Application No. 10-2017-0102592 filed on Aug. 11, 2017, and all the benefits accruing therefrom under 35 U.S.C. § 119, the contents of which is incorporated by reference in its entirety.

BACKGROUND OF THE INVENTION

1. Field of the Invention

The present invention relates to an AC (alternating current) voltage direct-coupled type LED driving apparatus, and more particularly, to a free voltage LED driving device with a high luminous uniformity ratio, capable of driving with a high luminous uniformity ratio by detecting when an external supply AC voltage changes in an LED lighting apparatus to vary and adjust a resistance value so that power is output in a constant manner regardless of the different AC rated voltage of each country.

2. Description of the Related Art

Conventional general lighting apparatuses have incandescent lamps that generate light due to high temperatures, and fluorescent lamps that generate light by high voltage discharges. Since they operate at a high temperature and a high voltage, they do not last very long.

Recently developed LEDs have a long life due to light generated by electron-hole pairs in a semiconductor as the current flows and operating at a low voltage and a low current.

Methods of constant voltage and constant current are commonly used in order to drive such LEDs.

Among these, the constant current driving method is widely used, and a voltage of an LED array is usually driven to 48V or less.

Therefore, a transformer is mainly used to obtain a low voltage from a high AC voltage power source of about 100V to 277V.

If a low-frequency AC power source is applied to a transformer as it is, the transformer must be very large, so switching is performed to change to a high frequency and a relatively small transformer is used.

At this time, noise due to high frequency, harmonics, power factor control and the like are difficult to realize, and so a very complicated circuit is implemented.

For this reason, the price is high, the reliability is low, and the life span is short, causing problems of having to repair or replace within several years.

In recent years, an AC voltage direct-coupled type LED driving method capable of solving these problems has been implemented in a compact, economical, and highly reliable manner and is widely used.

However, there are many points to be improved in the function of the AC voltage direct-coupled type LED driving method.

In general, an AC voltage direct-coupled type LED driving device is configured to have an AC power source, a rectifier, an LED, a switching device, and a current control resistance.

The power is controlled by the current control resistance.

As the magnitude of the current control resistance increases, the power decreases, and as the magnitude of the current control resistance decreases, the power increases.

There are three types of switching devices for configuring such an AC direct-coupled type LED driving device according to a connection method with the LED, that is, a series type, the parallel type, and the current drain type.

The first type of switching device, the series type switching device, is connected in series to the (−) terminal of the LED array. When the switch is on, the LED is lit, and when the switch is off, the LED is off.

The second type of switching device, the parallel type switching device, is connected in parallel at both ends of the LED array. When the switch is on, the LED is turned off, and when the switch is off, the LED is lit.

At a state where the AC voltage is lower than the voltage of the first LED array, the LED is turned off.

When the AC voltage becomes higher than the voltage of the first LED array, the LED is lit.

When the AC voltage is higher than the sum of the first and second LED array voltages, the first and second LED arrays are lit.

As the AC voltage further increases, the LED arrays are lit sequentially.

As described above, when the series and parallel type switching devices are arranged corresponding to a number of LED arrays by a general method, there is a problem that they are sequentially turned on.

In order to solve this problem, switching devices may be appropriately added and arranged in a number more than the LED arrays to make it possible for all LED arrays to be lit simultaneously at an AC voltage higher than or equal to the LED array voltage.

Such a simultaneous lighting method has a very good luminous uniformity ratio characteristic upon dimming.

In such a simultaneous lighting method, there are cases where only a parallel type switching device is used and a case where a parallel type and a series type switching device are used in combination.

However, in the case of using a series type switching device, operation is possible even when a current control resistance is arranged only in one place, but when a parallel type switching device is used, a current control resistance should be arranged for each switching device.

In order to solve the problem of arranging current control resistances in various places, there is a third type switching device, a current drain switching device.

A current drain switching device is a device that has a function of sensing when a current of an LED array flows to its corresponding series type switching device to allow a desired drain current to flow from a (+) terminal of an LED array to a (+) terminal of a next LED array.

By using this current drain switching device, it is possible to divert the current to each LED array to be proportional to the current controlled by the series switching device by a resistance arranged for controlling the current of the series switching device.

However, when the AC voltage fluctuates or the voltage differs for each country or region, the device must be newly designed and manufactured considering the voltage.

Since more than two voltages are usually used in each country, two or more products with different rated voltages are required.

The typical AC voltage range for each country is in the range of 100V to 277V.

However, when installing a LED light emitting device, an electronic device, or electric equipment using a TRIAC dimmer or a 0-10V dimmer equipped with an LED, there is the risk of safety problems such as overheating, destruction, fire and the like due to malfunctioning.

As prior arts, there is (Patent Document 1) KR 10-1217063 B1.

SUMMARY OF THE INVENTION

The present disclosure is directed to providing a free voltage LED driving device with a high luminous uniformity ratio that enables driving an LED lighting apparatus directly coupled with AC voltage with a high luminous uniformity ratio, and that enables driving with a constant power regardless of different AC rated voltages of each country, by detecting when an external supply AC voltage changes to vary and adjust a resistance value so that power is output in a constant manner.

A free voltage LED driving device with a high luminous uniformity ratio according to an exemplary embodiment of the present disclosure may be provided with: a rectifying device for rectifying an alternating current (AC) voltage applied thereto from outside and outputting a direct current (DC) voltage, a plurality of LED array parts connected in series to each other to have the DC voltage applied thereto to emit the light emitting diodes, a plurality of current drain switching devices positioned between each of the plurality of LED array parts to have current that is output from each of the plurality of LED array parts applied thereto, outputting a plurality of currents having a drain current value, a series type switching device controlling a transfer of current according to an opening and closing of a plurality of built-in transistors by having the plurality of currents applied thereto, a current control variable resistance part connected to the series type switching device for varying and adjusting a resistance value so that power is output in a constant manner when the applied AC voltage changes, and a voltage detecting circuit part having one side connected to the rectifying device to detect the DC voltage and another side connected to the current control variable resistance part to control a variation of the resistance value.

The current control variable resistance part of a free voltage LED driving device with a high luminous uniformity ratio according to an exemplary embodiment of the present disclosure includes an equivalent resistance ($R_S$) that is calculated by the following equation, $R_S=V_{AC}V_C/\sqrt{2}P$, wherein the P is a power of the LED driving device, the $V_{AC}$ is the current voltage applied from outside, and the $V_C$ is a maximum voltage value of the current control variable resistance.

The voltage detecting circuit part of a free voltage LED driving device with a high luminous uniformity ratio according to an exemplary embodiment of the present disclosure may be provided with: first to third branch resistances that are connected in a series wherein one side is connected to a (+) terminal of the rectifying device to have the DC voltage applied thereto and another side is grounded to branch the applied DC voltage; a DC voltage charging part connected to the second and third branch resistances in parallel to charge the branched DC voltage; and a first switching part connected to the DC voltage charging part in parallel, which opens and closes according to a magnitude of a DC voltage branched to the third branch resistance, to adjust a magnitude of the charged DC voltage to output to an output voltage port.

The DC voltage charging part of a free voltage LED driving device with a high luminous uniformity ratio according to an exemplary embodiment of the present disclosure may be provided with: a first capacitor wherein one side is connected to a second DC voltage terminal to have the DC voltage applied thereto and another side is grounded; and a Zener diode connected to the first capacitor in parallel to prevent an overvoltage of the charged DC voltage.

The first switching part of a free voltage LED driving device with a high luminous uniformity ratio according to an exemplary embodiment of the present disclosure may be provided with: a first field effect transistor wherein a gate terminal is connected to a third DC voltage terminal, and a source terminal is grounded; a drain resistance having one side connected to a first DC voltage terminal and another side connected to a drain terminal of the first field effect transistor; a source resistance having one side connected to a source terminal of the first field effect transistor and another side grounded; and a second capacitor having one side connected to a drain terminal of the first field effect transistor and the output voltage port and another side grounded.

The plurality of LED array parts of a free voltage LED driving device with a high luminous uniformity ratio according to an exemplary embodiment of the present disclosure may be characterized in that when there are four LED array parts, a basic driving voltage is 53 to 79 V.

The plurality of LED array parts of a free voltage LED driving device with a high luminous uniformity ratio according to an exemplary embodiment of the present disclosure may be characterized in that a number of LEDs are configured to be connected in parallel in a ratio of 3:1:1:1.

The plurality of LED array parts of a free voltage LED driving device with a high luminous uniformity ratio according to an exemplary embodiment of the present disclosure may be characterized in that a number of LEDs are configured to be connected in parallel in a ratio of 4:2:1:1.

The plurality of LED array parts of a free voltage LED driving device with a high luminous uniformity ratio according to an exemplary embodiment of the present disclosure may be characterized in that when there are 5 LED array parts, a basic driving voltage is 40 to 60 V.

The plurality of LED array parts of a free voltage LED driving device with a high luminous uniformity ratio according to an exemplary embodiment of the present disclosure may be characterized in that a number of LEDs are configured to be connected in parallel in a ratio of 4:1:1:1:1.

The plurality of LED array parts of a free voltage LED driving device with a high luminous uniformity ratio according to an exemplary embodiment of the present disclosure may be characterized in that a number of LEDs are configured to be connected in parallel in a ratio of 6:2:2:1:1.

The plurality of LED array parts of a free voltage LED driving device with a high luminous uniformity ratio according to an exemplary embodiment of the present disclosure may be characterized in that when there are 6 LED array parts, a basic driving voltage is 36 to 54 V.

The plurality of LED array parts of a free voltage LED driving device with a high luminous uniformity ratio according to an exemplary embodiment of the present disclosure may be characterized in that a number of LEDs are configured to be connected in parallel in a ratio of 3:3:2:2:1:1.

The current control variable resistance part of a free voltage LED driving device with a high luminous uniformity ratio according to an exemplary embodiment of the present disclosure may be provided with: a second field effect transistor receiving a current by having a drain terminal connected to the series type switching device, which opens and closes according to a magnitude of an output voltage applied by having a gate terminal connected to the output voltage port; a first control resistance having one side connected to a drain terminal of the field effect transistor and another side grounded; and a second control resistance having one side connected to a source terminal of the field effect transistor and another side grounded.

The current control variable resistance part of a free voltage LED driving device with a high luminous uniformity ratio according to an exemplary embodiment of the present disclosure may be replaceable with an analog dimming terminal.

The current control variable resistance part of a free voltage LED driving device with a high luminous uniformity ratio according to an exemplary embodiment of the present disclosure may be replaceable with a reference voltage generator.

The series type switching device of a free voltage LED driving device with a high luminous uniformity ratio according to an exemplary embodiment of the present disclosure may be provided with a plurality of field effect transistors opening and closing in response to a magnitude of voltage being applied to a gate terminal by having a drain terminal connected to the plurality of current drain switching devices, respectively, and having a source terminal connected to the current control variable resistance part through a common node.

The details of other embodiments are included in the 'detailed description of the invention' and the accompanying drawings.

The advantages and/or features of the present invention and the manner of achieving them will become apparent by reference to various embodiments described in detail below with reference to the accompanying drawings.

However, the present invention is not limited to the configurations of the embodiments described below, but may be embodied in various other forms, and each embodiment disclosed in this specification is intended to be illustrative only, and it will be understood by those of ordinary skill in the art that various changes in form and details may be made therein without departing from the spirit and scope of the invention as defined by the appended claims.

According to the present invention, it is possible for one AC direct-coupled type LED driving device to operate at a same power from low voltage to high voltage, and change in brightness of a driving device due to instantaneous voltage fluctuation to be reduced.

Further, safe driving is possible even when a high voltage is generated that is higher than a rated voltage for use, and the brightness may be controlled well even when a dimmer is used.

In addition, when installing electronic apparatuses or electric equipment provided with LEDs having different rated voltages for each country, it is possible to prevent the danger of overheating, destruction, fire, and the like, due to malfunction, and the performance of the product may be improved.

DETAILED DESCRIPTION OF THE INVENTION

Figure 1:
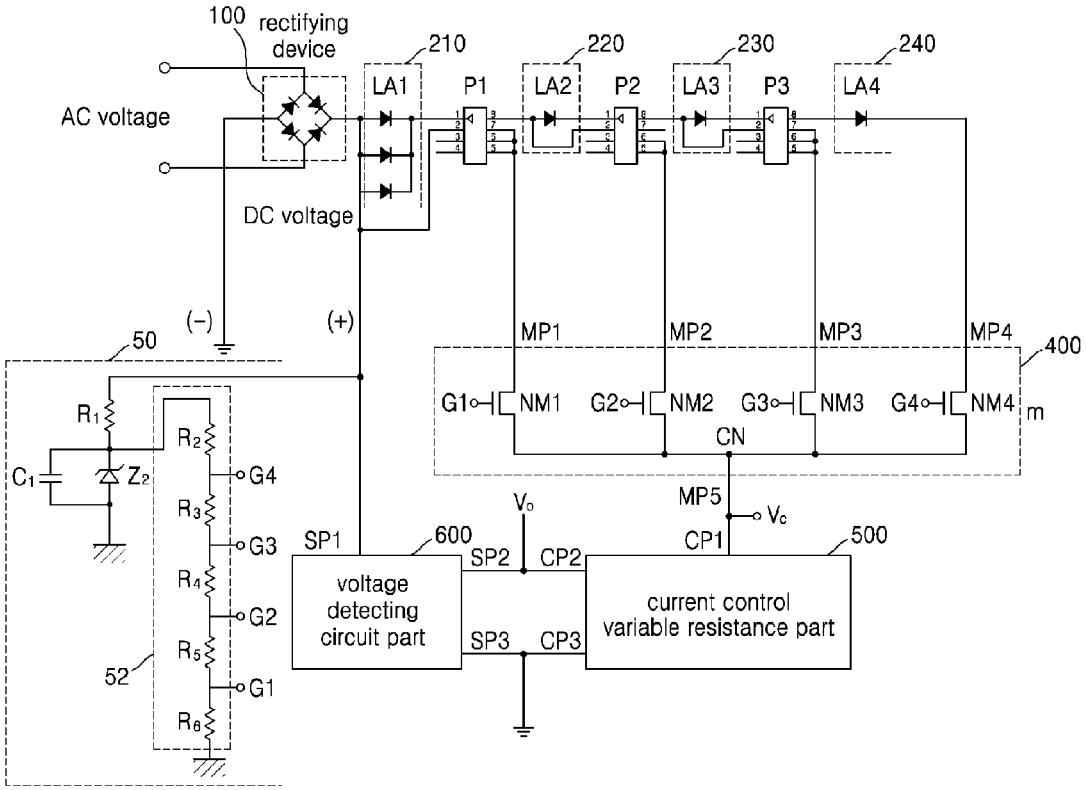
FIG. 1 is a circuit diagram of a free voltage LED driving device with a high luminous uniformity ratio according to an exemplary embodiment of the present invention.

Hereinafter, an exemplary embodiment of the present invention will be described in detail with reference to accompanying drawings.

Before describing the present invention in detail, terms and words used herein should not be construed in an ordinary or dictionary sense and should not be construed as limiting the invention to the inventors of the present invention in the best way possible, and it is to be understood that the concepts of various terms can be properly defined and used.

Further, these terms and words should be construed as meaning and concept consistent with the technical idea of the present invention.

That is, the terms used herein are used only to describe preferred embodiments of the present invention, and are not intended to specifically limit the contents of the present invention.

It should be noted that this is a defined term considering that many possibilities of the present invention.

Also, in this specification, the singular forms include plural referents unless the context clearly dictates otherwise.

Further, it should be understood that even if they are expressed in plural they may include singular meaning.

Where a component is referred to as "comprising" another component throughout this specification, unless specified otherwise, this means the component does not exclude any other element but may further include any other element.

Further, when it is stated that an element is "inside or connected to another element", this element may be directly connected to another element or may be installed in contact with it.

Further, it may be installed spaced apart with a predetermined distance, and in the case where a component is installed to be spaced apart with a predetermined distance, a third component or means for fixing or connecting the component to another component may be present, and it should be noted that the description of the third component or means may be omitted.

On the other hand, it should be understood that there is no third component or means when an element is described as being "directly coupled" or "directly connected" to another element.

Likewise, other expressions that describe the relationship between the components, such as "between" and "right between ~", or "neighboring to" and "directly adjacent to" and such should be understood in the same spirit.

Further, in this specification, when terms such as "one surface", "other surface", "one side", "other side", "first", "second" and such are used, it is to clearly distinguish one component from another.

However, it should be understood that the meaning of the component is not limited by such terms.

It is also to be understood that terms related to positions such as "top", "bottom", "left", "right" in this specification are used to indicate relative positions in the drawings for the respective components.

Unless an absolute position is specified for these positions, it is not to be understood that these position-related terms refer to absolute positions.

Furthermore, in the specification of the present invention, the terms "part", "unit", "module", "device" and the like mean a unit capable of handling one or more functions or operations.

This may be implemented as hardware or software, or a combination of hardware and software.

In addition, in this specification, the same reference numerals are used for the respective constituent elements of the drawings, and the same constituent elements are denoted by the same reference numerals even if they are shown in different drawings, that is, the same reference numerals indicate the same components throughout this specification.

It is to be understood that the size, position, coupling relationships and such, of each component constituting the present invention in the accompanying drawings, may be partially exaggerated or reduced or omitted to be able to sufficiently clearly convey the scope of the invention or for convenience of describing, and therefore the proportion or scale thereof may not be rigorous.

Also, in the following description of the present invention, a detailed description of a configuration that is considered to unnecessarily obscure the gist of the present invention, for example, a known technology including the prior art, may be omitted.

FIG. 1 is a circuit diagram of a free voltage LED driving device with a high luminous uniformity ratio according to an exemplary embodiment of the present invention, and is provided with a bias voltage supply part 50, a rectifying device 100, four LED array parts 210 to 240 indicated by LA1 to LA4, three current drain switching devices P1 to P3, one serial type switching device 400 indicated by m, a current control variable resistance part 500 and a voltage detecting circuit part 600.

Figure 2:
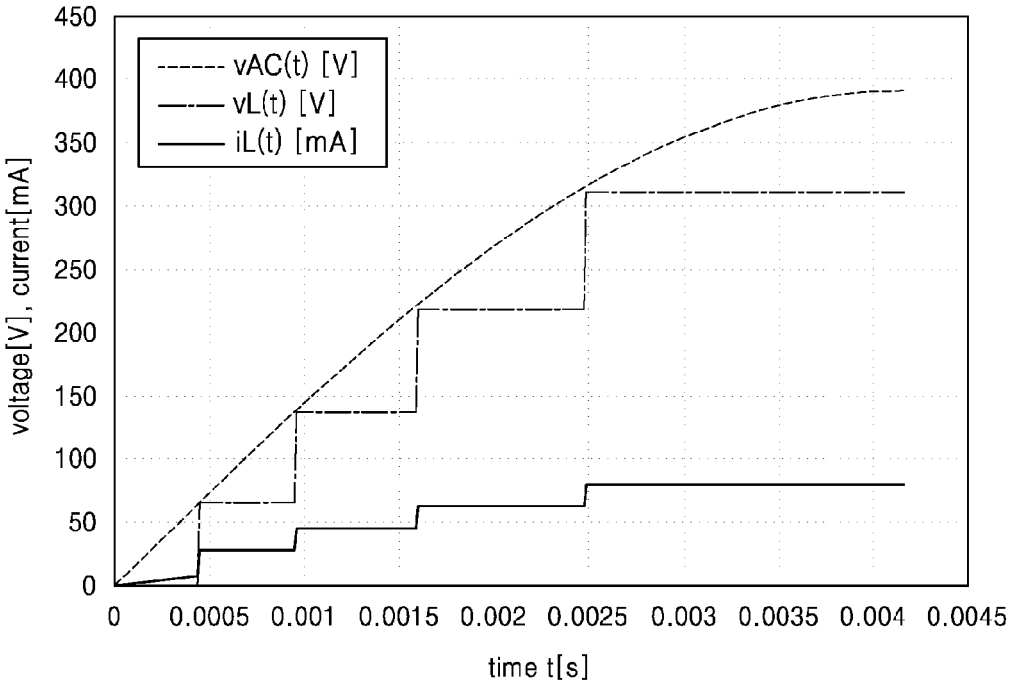
FIG. 2 is a waveform diagram showing a quarter period waveform of AC voltage according to time, and a driving voltage and driving current of an LED array according to time, when the circuit shown in FIG. 1 is driven.

FIG. 2 is a waveform diagram showing a quarter period waveform of AC voltage according to time, and a driving voltage and driving current of an LED array part 210 to 240 according to time, when the circuit shown in FIG. 1 is driven.

Figure 3:
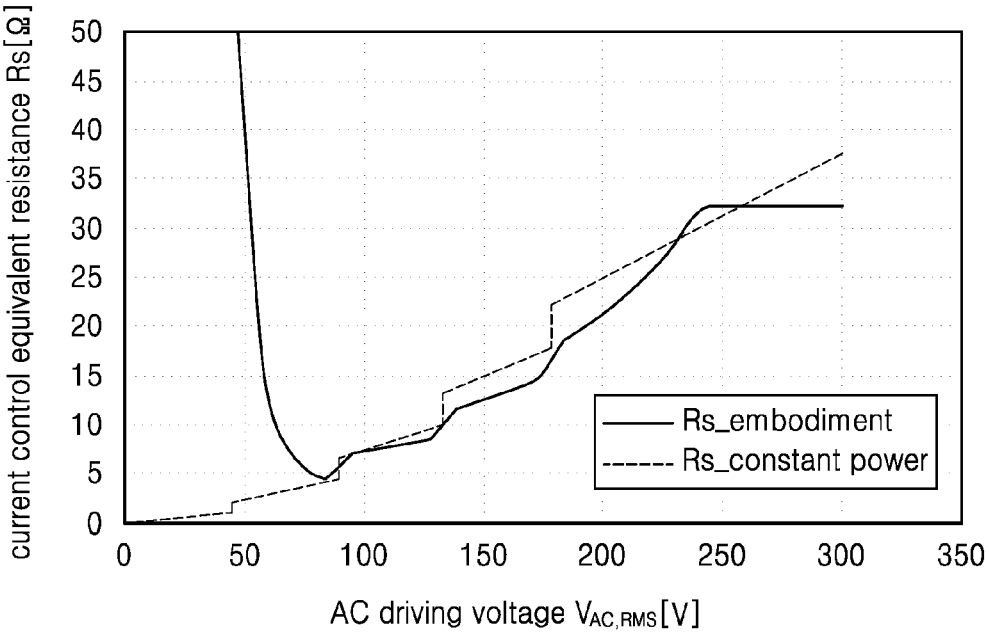
FIG. 3 is a waveform diagram showing an equivalent resistance value ($R_S$) of a current control variable resistance part required for each applied AC voltage in order to implement a constant power of 17 W in the circuit shown in FIG. 1.

FIG. 3 is a waveform diagram showing an equivalent resistance value ($R_S$) of a current control variable resistance part 500 required for each applied AC voltage in order to implement a constant power of 17 W in the circuit shown in FIG. 1.

Referring to FIGS. 1 to 3, the structure and function of each configuration of a free voltage LED driving device with a high luminous uniformity ratio according to an exemplary embodiment of the present invention is described as follows.

A rectifying device 100 rectifies an AC voltage applied thereto from outside to output a DC voltage.

Four LED array parts 210 to 240 are connected in series to each other to have the DC voltage applied thereto from a rectifying device 100 to emit a light emitting diode.

Three drain switching devices P1 to P3 are positioned between each of the four LED array parts 210 to 240 to have current that is output from each of the four LED array parts 210 to 240 applied thereto, to output a plurality of currents having a drain current value in response to a control of a series type switching device 400.

One series type switching device 400 is provided with four NMOS transistors NM1 to NM4 wherein a drain terminal is connected to three current drain switching devices P1 to P3, respectively, and a source terminal is connected to a current control variable resistance part 500 through a common node CN, and which opens and closes in response to a magnitude of a voltage applied to a gate terminal.

A current control variable resistance part 500 is connected to the series type switching device 400 for varying and adjusting a resistance value so that power is output in a constant manner even when an AC voltage supplied from outside changes.

A voltage detecting circuit part 600 has one side connected to the rectifying device 100 and another side connected to the current control variable resistance part 500, to detect a DC voltage output from the rectifying device 100 and controls an operation of a transistor embedded in the current control variable resistance part 500.

In FIG. 1, the four LED array parts 210 to 240 are configured to be connected in series as an example, but it can be configured as an arbitrary L number of LED array parts, and in this case, a basic driving voltage of the LED array parts 210 to 240 and a ratio of a number of LEDs connected in parallel may be set differently.

For example, in the case where there are four LED array parts, each of the voltages of the LED arrays are 66V 20%, that is, 53 to 79 V is the basic driving voltage.

In this case, the ratio of the number of LEDs connected in parallel that configure the plurality of LED array parts may be set to 3:1:1:1 or 4:2:1:1.

Further, in the case where there are five LED array parts, each of the voltages of the LED arrays are 50V 20%, that is, 40 to 60 V is the basic driving voltage.

In this case, the ratio of the number of LEDs connected in parallel that configure the plurality of LED array parts may be set to 4:1:1:1:1 or 6:2:2:1:1.

Further, in the case where there are six LED array parts, each of the voltages of the LED arrays are 45V 20%, that is, 40 to 60 V is the basic driving voltage.

In this case, the ratio of the number of LEDs connected in parallel that configure the plurality of LED array parts may be set to 3:3:2:2:1:1.

Meanwhile, when an L number of LED array parts 210 to 240 are configured, an L number of NMOS transistors in the series type switching device 400 are also configured, but the number of the current drain switching devices P1 to P3 is configured to be L−1.

Referring to FIGS. 1 to 3, the operation of a free voltage LED driving device with a high luminous uniformity ratio according to an exemplary embodiment of the present invention is described in detail as follows.

The LED array part 210 to 240 in FIG. 1 shows an exemplary embodiment configuring a basic 72V LED array when typically and generally driving in a 24-series.

The first LED array LA1 has 3 parallel rows, and the second to fourth LED arrays LA2 to LA4 are each configured to have one parallel row.

The operation feature of the current drain switching devices P1 to P3 in FIG. 1 is as follows.

When an applied AC voltage becomes a voltage of about 72 V or more, corresponding to the basic voltage of the LED array parts 210 to 240, a current of N times the current flowing from a first terminal of the switching device to a fifth terminal according to an on-off operation of the transistor embedded in the current drain switching device P1 to P3, flows from a second terminal to an eighth terminal to light up all of LA1 to LA4.

When an applied AC voltage becomes a voltage higher than two to four times the basic voltage of the LED array parts 210 to 240 and thereby a current higher than the current of a corresponding channel of the series type switching device 400 flows to a next channel, the corresponding channel is opened and the current entering a second terminal of the current drain switching devices P1 to P3 also becomes zero.

Accordingly, the voltage increases from the current drain switching devices P1 to P3, and the current flows directly from the first terminal to the eighth terminal while being sequentially disconnected.

In the case of FIG. 1, the ratio of the current flowing from the first terminal to the fifth terminal compared to the current flowing from the second terminal to the eighth terminal is set to be 1:1, 1:2, and 1:1 at P1 to P3, respectively.

When the current drain switching devices P1 to P3 are set to the above-mentioned ratio, in a case where the AC voltage is driven at 120 V, the current is driven in two steps, and when driven with a first channel current value, the LED array parts 210 to 240 are driven in six parallel rows.

Further, when driven with a second channel current value, LA2 to LA4 are connected in parallel and the LA2 to LA4 connected in parallel are connected in series with LA1, and driven in two series and three parallel rows, the current flowing to each LED becomes the same, thereby being driven at 100% luminous uniformity ratio.

When the AC power source is driven at a higher voltage, the magnitude of the current flowing to each LED array part 210 to 240 is changed, but the light efficiency is substantially constant to when it was 120 V, so it becomes possible to be driven at a high light efficiency.

The structural features of a series type switching device 400, a voltage detecting circuit part 600, and a current control variable resistance part 500 shown in FIG. 1 to FIG. 4 is as follows.

The series type switching device 400 is provided with a plurality of field effect transistors NM1 to NM4 wherein a drain terminal is connected to a plurality of current drain switching devices P1 to P3, respectively, and a source terminal is connected to the current control variable resistance part 500 through a common node CN, and which opens and closes in response to a magnitude of a voltage applied to a gate terminal.

At this time, the voltage being applied to the respective gate terminal of the plurality of field effect transistors NM1 to NM4 is supplied from a bias voltage supply part 50.

That is, the bias voltage supply part 50 is provided with a bias voltage branch resistance part 52, a power source voltage drop resistance $R_1$, a DC power source voltage stabilization part $C_1$, and an overvoltage prevention part $Z_2$.

The bias voltage branch resistance part 52 is provided with first to fifth voltage branch resistances $R_2$ to $R_6$, and one side is connected to a (+) terminal of the rectifying device 100 to have a DC voltage applied thereto, and another side is grounded to branch the applied DC voltage.

The power source voltage drop resistance $R_1$ drops the power source voltage by having one side connected to a (+) terminal of the rectifying device 100 and another side connected to one side of the bias voltage branch resistance part 52.

The DC power source voltage stabilization part $C_1$ is connected to the bias voltage branch resistance part 52 in parallel to stabilize the DC power source voltage.

The overvoltage prevention part $Z_2$ is connected to the DC power source voltage stabilization part $C_1$ in parallel to prevent the flowing in of overvoltage of the DC power source voltage from a surge voltage that flows in rapidly from lightning and such.

Accordingly, the bias voltage branched through the second to fifth voltage branch resistances $R_3$ to $R_6$ in the bias voltage branch resistance part 52 is applied to the gate terminal of the fourth field effect transistor NM4, and the bias voltage branched through the third to fifth branch resistances $R_4$ to $R_6$ is applied to the gate terminal of the third field effect transistor NM3.

Further, the bias voltage branched through the fourth to fifth voltage branch resistances $R_5$ to $R_6$ is applied to the gate terminal of the second field effect transistor NM2, and the bias voltage branched through the fifth branch resistance $R_6$ is applied to the gate terminal of the first field effect transistor NM1.

Further, the voltage detecting circuit part 600 is provided with first to third branch resistances 610 wherein one side is connected to a (+) terminal of the rectifying device 100 to have the DC voltage applied thereto and another side is grounded to branch the applied DC voltage, a DC voltage charging part 620 connected to the second and third branch resistances ($R_{V2}$, $R_{V3}$) in parallel to charge the branched DC voltage, and a first switching part 630 which adjusts and outputs the magnitude of a DC voltage that is charged according to the magnitude of the DC voltage branched to the third branch resistance $R_{V3}$.

At this time, the DC voltage charging part 620 is provided with a first capacitor $C_{V1}$ wherein one side is connected to a second DC voltage terminal V2 to have the DC voltage applied thereto and another side is grounded, and a Zener diode $Z_1$ connected to the first capacitor $C_{V1}$ in parallel to prevent an overvoltage of the charged DC voltage.

Further, the first switching part 630 is provided with a first field effect transistor T1 wherein a gate terminal is connected to a third DC voltage terminal V3, and a source terminal is grounded, a drain resistance $R_{VD}$ having one side connected to a first DC voltage terminal V1 and another side connected to a drain terminal of the first field effect transistor T1, a source resistance having one side connected to a source terminal of the first field effect transistor T1 and another side grounded, and a second capacitor $C_{V2}$ having one side connected to a drain terminal of the first field effect transistor T1 and the output voltage port $V_O$ and another side grounded.

Meanwhile, the current control variable resistance part 500 is provided with a second field effect transistor T2 receiving a current by having a drain terminal connected to a common node CN of the series type switching device 400, which opens and closes according to a magnitude of an output voltage applied by having a gate terminal connected to the output voltage port $V_O$, a first control resistance $R_{S1}$ having one side connected to a drain terminal of the second field effect transistor T2 and another side grounded, and a second control resistance $R_{S2}$ having one side connected to a source terminal of the second field effect transistor T2 and another side grounded.

The operation features of a series type switching device 400, a voltage detecting circuit part 600, and a current control variable resistance part 500 shown in FIG. 1 to FIG. 4 is as follows.

The gate voltage of the field effect transistor (FET) having a drain terminal connected to first to fourth terminals of the series type switching device 400 is set to be sequentially increased.

Accordingly, in accordance to the increase of DC voltage being output from the rectifying device 100, the series type switching device 400 is driven with the set current values of the first to fourth terminals increasingly for each voltage of the LED array parts 210 to 240 (in the case of FIG. 1, each step of about 72 V) of the current drain switching devices P1 to P3, and upon driving with a current value of a next step, the prior field effect transistor is cut-off.

Therefore, although the detailed operation differs depending on the type of switching device, the circuit of FIG. 1 also basically operates by having current drain switching devices P1 to P3 connected in parallel to LEDs in four LED array parts 210 to 240 according to the value of the current control variable resistance part 500 of the series type switching device 400, to show a current waveform such as FIG. 2 according to voltage fluctuation and the LED is lit.

However, current is divided and flows in the channels that are not cut-off due to the operation of the current drain switching devices P1 to P3.

FIG. 2 shows a portion of a period when the circuit of FIG. 1 is driven at 277V.

At this time $v_L(t)$ is the voltage applied to the LEDs in the four LED array parts 210 to 240 due to AC voltage that changes according to time, and $i_L(t)$ is current that changes according to time.

$V_{AC}$ is the value of RMS AC voltage, and $I_L$ is the value of maximum current flowing in the circuit.

$v_C(t)$ is the voltage of the current control variable resistance part 500, and is expressed as a product of an equivalent resistance $R_S$ of the current control variable resistance part 500 and current $i_L(t)$.

N refers to the number of steps until reaching the maximum current according to the applied AC voltage.

For example, in the circuit of FIG. 1, N is 2 when the RMS voltage is 120 V, and N is 4 when applied at 277V, as shown in FIG. 2.

In addition, the $V_C$ shown in FIG. 1 is the maximum voltage of $v_C(t)$ of the current control variable resistance part 500 at a driving AC voltage, which is calculated with the voltage value of the last step of $v_C(t)$ according to applied voltage.

The power P of an LED lighting apparatus when AC voltage is applied is expressed with the following equation 1.

$$P = \frac{1}{T}\int_O^T V_{AC}(t)i_L(t)\,dt \approx V_{AC}\frac{I_L}{\sqrt{2}} = V_{AC}\frac{V_C}{\sqrt{2Rs}} \quad \text{[Equation 1]}$$

Here, T is the time of one period of an AC power source voltage, $V_{AC}(t)$ is an AC voltage that changes according to time, and $i_L(t)$ is current that changes according to time.

Further, $V_{AC}$ is an AC voltage value applied from outside, and $I_L$ is a maximum current value flowing in the circuit.

Further, $V_C$ is a maximum voltage of $v_C(t)$ of the current control variable resistance part 500, and $R_S$ shows the equivalent resistance of the current control variable resistance part 500.

Then, the value of equivalent resistance $R_S$ of the current control variable resistance part 500 for making the power P constant is obtained by the following equation 2.

$$R_S = V_{AC}\frac{V_C}{\sqrt{2}\,P} \quad \text{[Equation 2]}$$

Here, P is the power of the LED driving device, $V_{AC}$ is the AC voltage value applied from outside, and $V_C$ shows the maximum voltage of voltage $v_C(t)$ of the current control variable resistance part 500.

In the case where four LED array parts 210 to 240 of FIG. 1 is used, when a graph of equivalent resistance $R_S$ of the current control variable resistance part 500 of an exemplary embodiment is calculated, it is like the 'RS_constant power' indicated with a dotted line of FIG. 3.

As the AC voltage increases, the equivalent resistance $R_S$ of the current control variable resistance part 500 must increase, but as the voltage increases, the LED voltage connected in series increases and the channel current of a series type IC increases in a stepped form, thereby the $V_C$ also increases in a stepped form, and so the current control resistance must also be increased in a stepped from to obtain a constant power.

Figure 5:
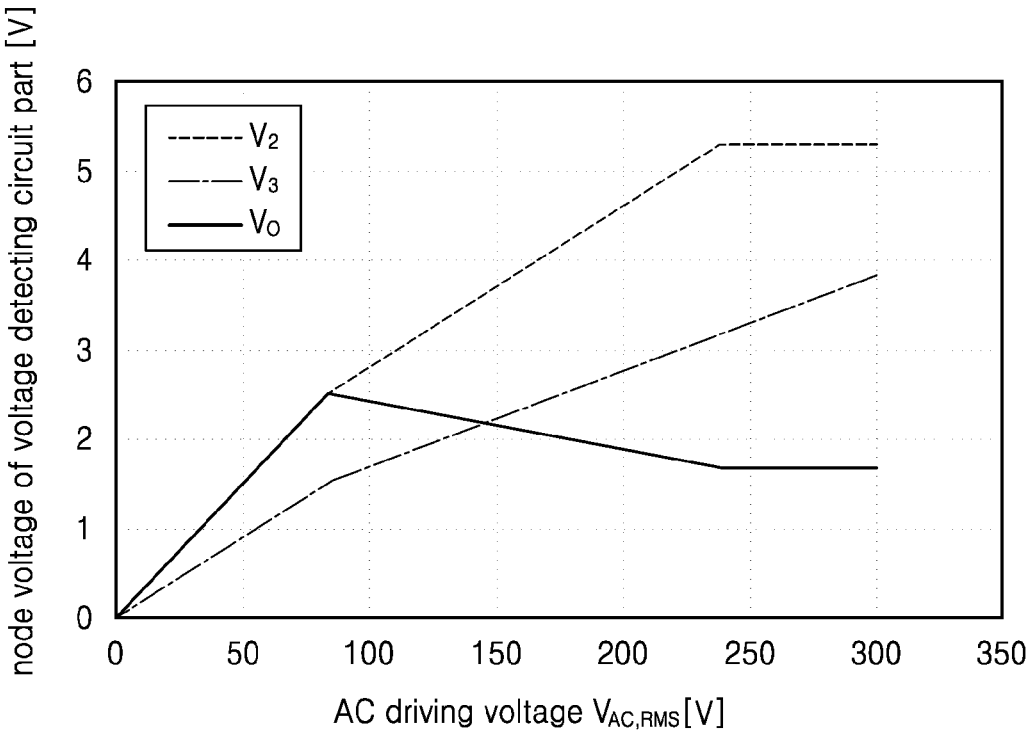
FIG. 5 is a graph showing a result of simulating each node voltage of the current control variable resistance part through the LED driving device shown in FIG. 1.

FIG. 5 is a graph showing a result of simulating each node voltage of the current control variable resistance part through the LED driving device shown in FIG. 1.

Figure 6:
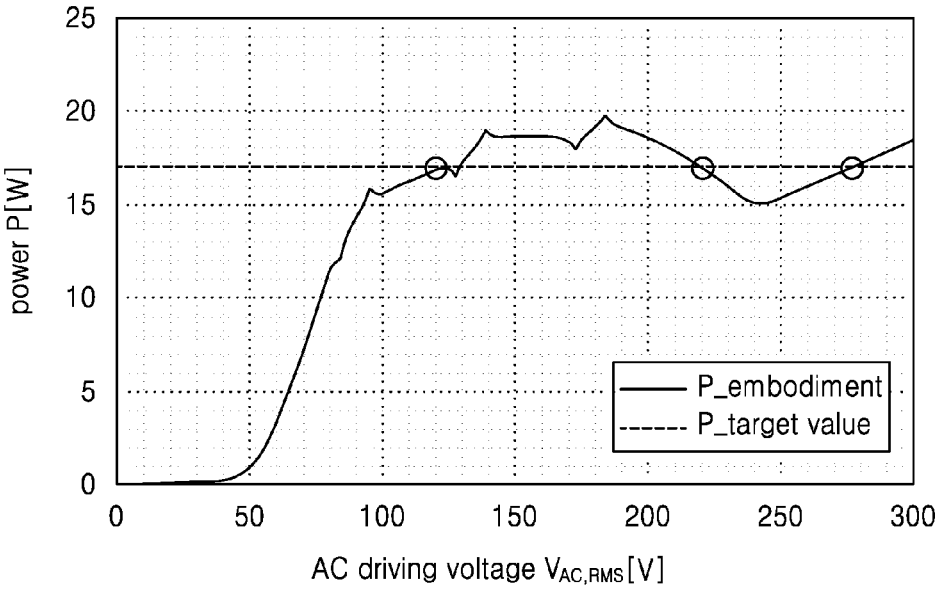
FIG. 6 is a graph comparing a result of simulating power according to an AC driving voltage applied to the LED driving device illustrated in FIG. 1 with a target power value.

FIG. 6 is a graph comparing a result of simulating power according to an AC driving voltage applied to the LED driving device illustrated in FIG. 1 with a target power value.

Figure 7:
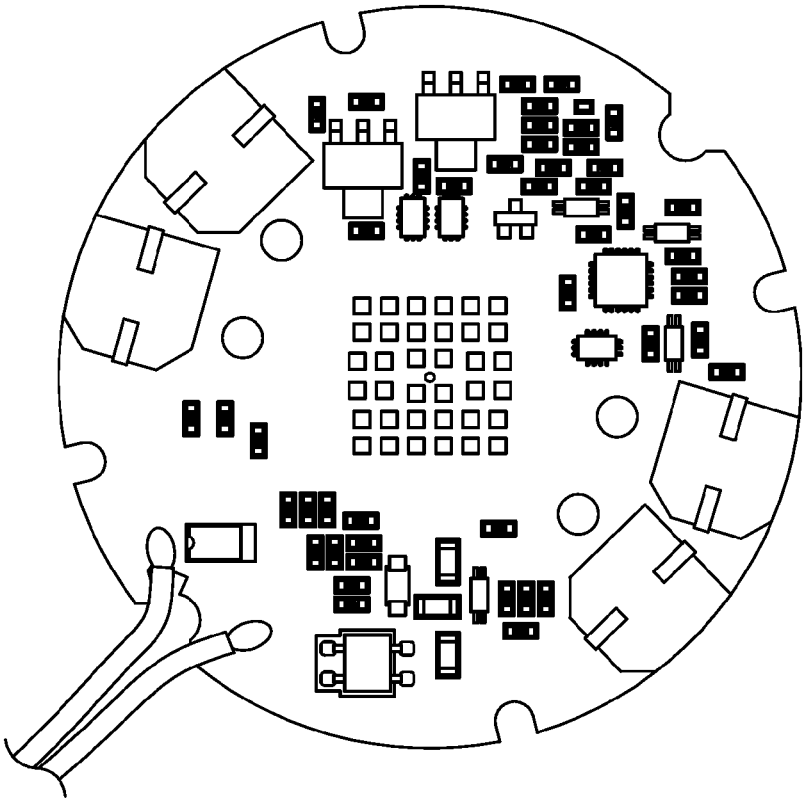
FIG. 7 is a photograph of the LED driving device shown in FIG. 1, configured as an actual circuit on a printed circuit board.

FIG. 7 is a photograph of the LED driving device shown in FIG. 1, configured as an actual circuit on a printed circuit board.

Figure 8:
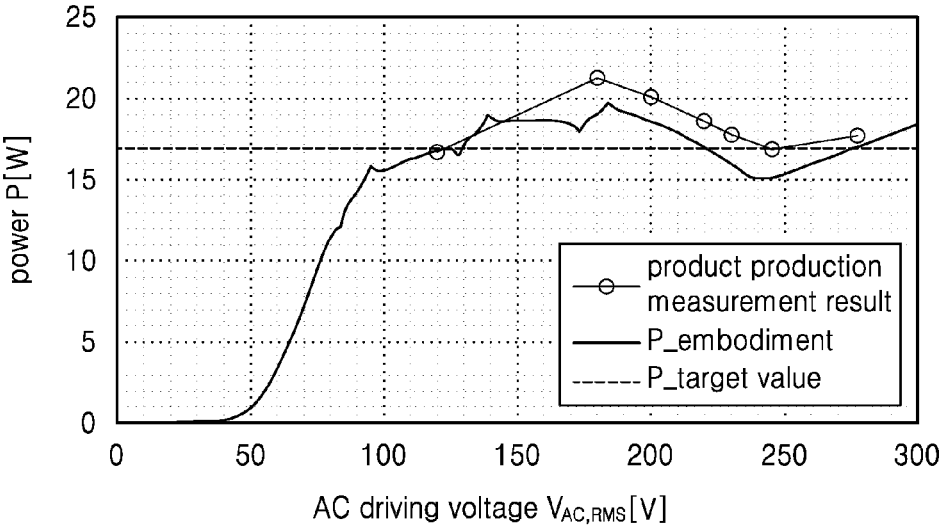
FIG. 8 is a graph comparing a power value measured through the actual LED circuit of the present invention shown in FIG. 7 with the simulation result and the target power value shown in FIG. 6.

FIG. 8 is a graph comparing a power value measured through the actual LED circuit of the present invention shown in FIG. 7 with the simulation result and the target power value shown in FIG. 6.

Referring to FIG. 1 to FIG. 8, a detailed description of an operation of a free voltage LED driving device with a high luminous uniformity ratio according to an exemplary embodiment of the present disclosure is as follows.

Figure 4:
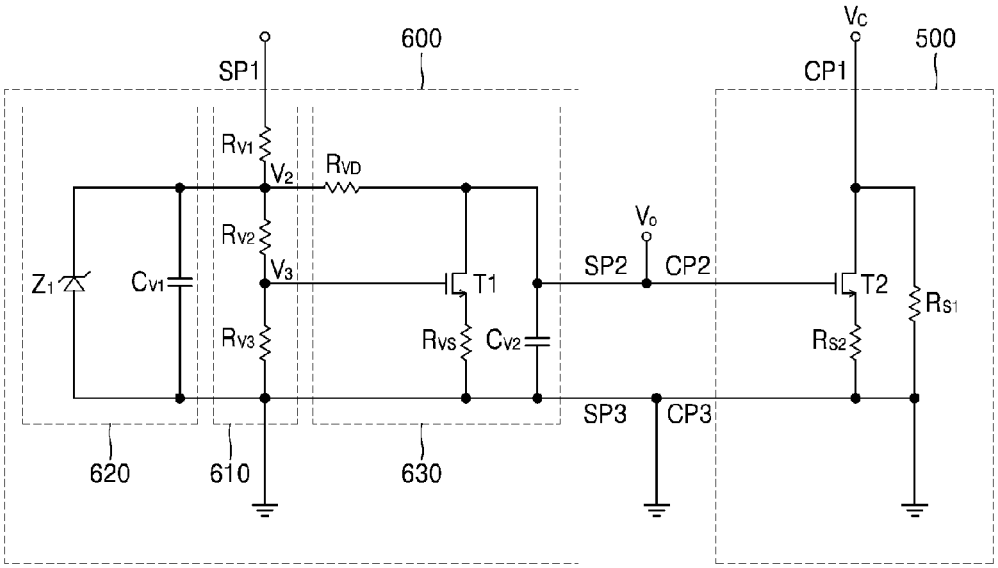
FIG. 4 is a circuit diagram of a voltage detecting circuit part and a current control variable resistance part in the LED driving device shown in FIG. 1.

As shown in FIG. 4, in the voltage detecting circuit part 600, there are three external connection ports SP1, SP2, SP3, and also in the current control variable resistance part 500, there are three external connection ports CP1, CP2, CP3.

The external connection port SP1 of the voltage detecting circuit part 600 is connected with a (+) end of the rectifying device rectifying voltage of FIG. 1.

The external connection port CP1 of the current control variable resistance part 500 is connected with the external connection port MP5 of the series type switching device 400 of FIG. 1.

The external connection port SP2 of the voltage detecting circuit part 600 is connected to the external connection port CP2 of the current control variable resistance part 500, and the external connection port SP3 of the voltage detecting circuit part 600 and the external connection port CP3 of the current control variable resistance part 500 are grounded together with a (−) end of the rectifying voltage of the rectifying device 100.

Three branch resistances $R_{V1}$, $R_{V2}$, $R_{V3}$ are connected to the external connection port SP1 of the voltage detecting circuit part 600, and the first branch resistance $R_{V1}$ decreases the voltage to enable parts connected to other terminals to operate at a low voltage.

Further, the second and third branch resistances $R_{V2}$, $R_{V3}$ branch the voltage together with the first branch resistance $R_{V1}$ to be proportional to the AC voltage, and by the capacitor $C_{V1}$ connected thereto in parallel, the branched voltage becomes a DC voltage in proportion to the AC voltage.

This second DC voltage $V_2$ supplies a power source to the drain resistance $R_{VD}$ connected to the drain of the transistor T1, and a third DC voltage $V_3$ is connected to the gate of the transistor T1.

When the AC voltage applied from outside increases in FIG. 1, the second DC voltage $V_2$ increases, and the transistor T2 of the current control variable resistance part 500 is completely turned on and the resistance between the external connection port CP1 and external connection port CP3 of the current control variable resistance part 500 is driven as a parallel resistance value of control resistance Rs1 and control resistance Rs2.

As the AC voltage supplied from outside increases and the second DC voltage $V_2$ increases accordingly, at the same time, while the third DC voltage $V_3$ increases, the transistor T1 of the voltage detecting circuit part 600 is slowly turned on.

Accordingly, while the current flows through the resistance $R_{VD}$, a drop in voltage occurs and the output voltage $V_O$ decreases.

Further, in a state where the transistor T2 of the current control variable resistance part 500 is completely turned on, the current decreases as the resistance increases and the resistance of both ends of the second control resistance $R_{S2}$ and the transistor T2 connected in series increases, and so when the AC driving voltage increase, the current decreases and the power becomes constant.

Therefore, the current control variable resistance part 500 of the present disclosure is replaceable with an analog dimming terminal or a reference voltage generator.

As shown in FIG. 6, when driving the LED driving device at AC voltages, 100V, 120V, 200V, 220V, 230V, 245V, 277V, which are AC voltages corresponding to each country, driving is done within 11% of a target power, and is driven within 16% and within a total voltage of 100 to 277V.

When the main voltage of interest is set to three voltages, 120V (USA), 220V (Asia, part of Europe) and 277V (USA), it can be seen that the LED driving device is driven at a substantially equal power within a 1% error rate of the target power.

Further, as shown in FIG. 8, with 17 W as the target power at a voltage of 120V, 277V used in USA and a voltage of 230V used in Europe, the power at the voltages is 16.7 W, 17.7 W, and 17.8, respectively, which is −1.8%, 4.1%, 4.8% based on 17 W, and the result shows that the power is constant at a satisfactory level.

Accordingly, the present disclosure provides a free voltage LED driving device with a high luminous uniformity ratio capable of driving with a high luminous uniformity ratio in a LED lighting apparatus that is directly coupled to an AC voltage and capable of being driving with a constant power regardless of the different AC rated voltage of each country, by detecting when an external supply AC voltage changes and varying and adjusting a resistance value so that power is output in a constant manner.

According to the present disclosure, it is possible for one AC direct-coupled type LED driving device to operate at a same power from low voltage to high voltage, and change in brightness of a driving device due to instantaneous voltage fluctuation to be reduced.

Further, safe driving is possible even when a high voltage is generated that is higher than a rated voltage for use, and the brightness may be controlled well even when a dimmer is used.

In addition, when installing electronic apparatuses or electric equipment provided with LEDs having different rated voltages for each country, it is possible to prevent the danger of overheating, destruction, fire, and the like, due to malfunction, and the performance of the product may be improved.

While the present invention has been particularly shown and described with reference to exemplary embodiments thereof, it is evident that many alternatives, modifications and variations will be apparent to those skilled in the art. It will be understood by those skilled in the art that various changes in form and details may be made therein without departing from the spirit and scope of the invention as defined by the appended claims.

In addition, since the present invention can be embodied in various forms, and should not be construed as being limited to the embodiments set forth herein. Rather, these embodiments are provided so that this disclosure will be thorough and complete and will fully convey the concept of the invention to those skilled in the art, and the present disclosure will only be defined by the appended claims.

Description of Symbols

100: rectifying device
210 to 240: LED array part
P1 to P3: current drain switching device
400: series type switching device
500: current control variable resistance part
600: voltage detecting circuit part

What is claimed is:

1. A free voltage LED driving device with a high luminous uniformity ratio comprises:

a rectifying device for rectifying an alternating current (AC) voltage applied thereto from outside and outputting a direct current (DC) voltage;

a plurality of LED array parts connected in series to each other to have the DC voltage applied thereto to emit light emitting diodes;

a plurality of current drain switching devices positioned between each of the plurality of LED array parts to have current that is output from each of the plurality of LED array parts applied thereto, outputting a plurality of currents having a drain current value;

a series type switching device controlling a transfer of current according to an opening and closing of a plurality of built-in transistors by having the plurality of currents applied thereto;

a current control variable resistance part connected to the series type switching device for varying and adjusting a resistance value so that power is output in a constant manner when the applied AC voltage changes; and a voltage detecting circuit part having one side connected to the rectifying device to detect the DC voltage and another side connected to the current control variable resistance part to control a variation of the resistance value.

2. The device of claim 1, wherein the current control variable resistance part comprises an equivalent resistance ($R_S$) that is calculated by the following equation, $$R_S = V_{AC}\frac{V_C}{\sqrt{2}\,P}$$

wherein the P is a power of the LED driving device, the $V_{AC}$ is the current voltage applied from outside, and the $V_C$ is a maximum voltage value of the current control variable resistance.

3. The device of claim 1, wherein the voltage detecting circuit part comprises, first to third branch resistances that are connected in a series wherein one side is connected to a (+) terminal of the rectifying device to have the DC voltage applied thereto and another side is grounded to branch the applied DC voltage;

a DC voltage charging part connected to the second and third branch resistances in parallel to charge the branched DC voltage; and a first switching part connected to the DC voltage charging part in parallel, which opens and closes according to a magnitude of a DC voltage branched to the third branch resistance, to adjust a magnitude of the charged DC voltage to output to an output voltage port.

4. The device of claim 3, wherein the DC voltage charging part comprises, a first capacitor wherein one side is connected to a second DC voltage terminal to have the DC voltage applied thereto and another side is grounded; and a Zener diode connected to the first capacitor in parallel to prevent an overvoltage of the charged DC voltage.

5. The device of claim 3, wherein the first switching part comprises, a first field effect transistor wherein a gate terminal is connected to a third DC voltage terminal, and a source terminal is grounded;

a drain resistance having one side connected to a first DC voltage terminal and another side connected to a drain terminal of the first field effect transistor;

a source resistance having one side connected to a source terminal of the first field effect transistor and another side grounded; and a second capacitor having one side connected to a drain terminal of the first field effect transistor and the output voltage port and another side grounded.

6. The device of claim 1, wherein the plurality of LED array parts are characterized in that when there are four LED array parts, a basic driving voltage is 53 to 79 V.

7. The device of claim 6, wherein the plurality of LED array parts is characterized in that a number of LEDs are configured to be connected in parallel in a ratio of 3:1:1:1.

8. The device of claim 6, wherein the plurality of LED array parts is characterized in that a number of LEDs are configured to be connected in parallel in a ratio of 4:2:1:1.

9. The device of claim 1, wherein the plurality of LED array parts is characterized in that when there are 5 LED array parts, a basic driving voltage is 40 to 60 V.

10. The device of claim 9, wherein the plurality of LED array parts is characterized in that a number of LEDs are configured to be connected in parallel in a ratio of 4:1:1:1:1.

11. The device of claim 9, wherein the plurality of LED array parts is characterized in that a number of LEDs are configured to be connected in parallel in a ratio of 6:2:2:1:1.

12. The device of claim 1, wherein the plurality of LED array parts is characterized in that when there are 6 LED array parts, a basic driving voltage is 36 to 54 V.

13. The device of claim 12, wherein the plurality of LED array parts is characterized in that a number of LEDs are configured to be connected in parallel in a ratio of 3:3:2:2:1:1.

14. The device of claim 3, wherein the current control variable resistance part comprises, a second field effect transistor receiving a current by having a drain terminal connected to the series type switching device, which opens and closes according to a magnitude of an output voltage applied by having a gate terminal connected to the output voltage port;

a first control resistance having one side connected to a drain terminal of the field effect transistor and another side grounded; and a second control resistance having one side connected to a source terminal of the field effect transistor and another side grounded.

15. The device of claim 1, wherein the current control variable resistance part is replaceable with an analog dimming terminal.

16. The device of claim 1, wherein the current control variable resistance part is replaceable with a reference voltage generator.

17. The device of claim 1, wherein the series type switching device comprises a plurality of field effect transistors opening and closing in response to a magnitude of voltage being applied to a gate terminal, by having a drain terminal connected to the plurality of current drain switching devices, respectively, and having a source terminal connected to the current control variable resistance part through a common node.

* * * * *